US005441778A

United States Patent [19]

Gilbreath et al.

[11] Patent Number: 5,441,778

[45] Date of Patent: Aug. 15, 1995

[54] 3-D ILLUSTRATION

[76] Inventors: Mykos M. Gilbreath; Jonathon L. Gilbreath; Jeremy C. Gilbreath, all of 908 Town & Country Blvd., Ste. 120, Houston, Tex. 77024

[21] Appl. No.: 116,062

[22] Filed: Sep. 2, 1993

[51] Int. Cl.[6] ..... B44C 5/04; G09F 1/00

[52] U.S. Cl. ..... 428/13; 40/160; 229/92.8; 428/542.4

[58] Field of Search ..... 428/13, 16, 542.4; 229/92.8; 40/160

[56] References Cited

U.S. PATENT DOCUMENTS

| | | | |
|---|---|---|---|
| 3,868,283 | 2/1975 | Scheyer | 428/13 X |
| 4,161,831 | 7/1979 | Restle | 428/13 X |
| 4,530,863 | 7/1985 | Seeger | 428/542.4 X |
| 4,979,619 | 12/1990 | Hager | 428/542.4 X |
| 5,270,101 | 12/1993 | Helicher | 428/542.4 X |

*Primary Examiner*—Henry F. Epstein

*Attorney, Agent, or Firm*—John R. Casperson

[57] ABSTRACT

Two dimensional artwork, such as photographs, posters, sports cards, comics cards and the like can be converted into three dimensional articles of artwork by mounting foreground figures provided from copies of the two-dimensional artwork onto the underlying two dimensional artwork.

10 Claims, 1 Drawing Sheet

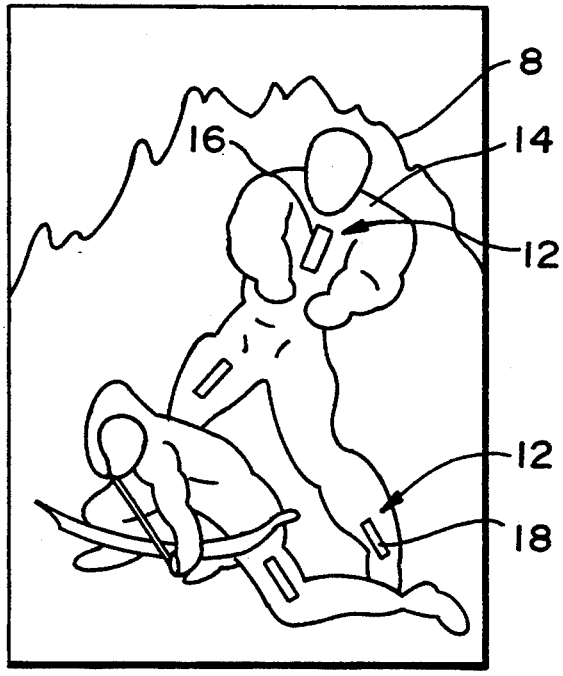
FIG. 1
FIG. 2
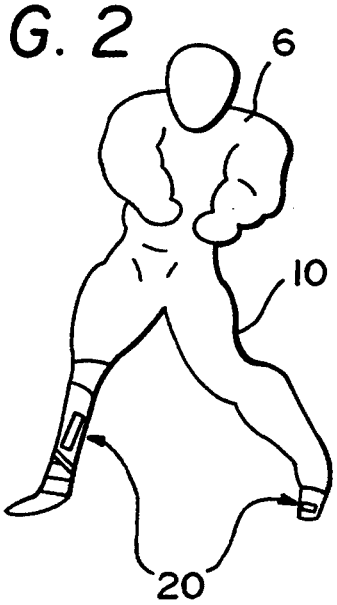
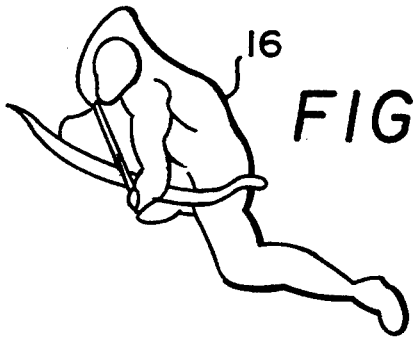
FIG. 3
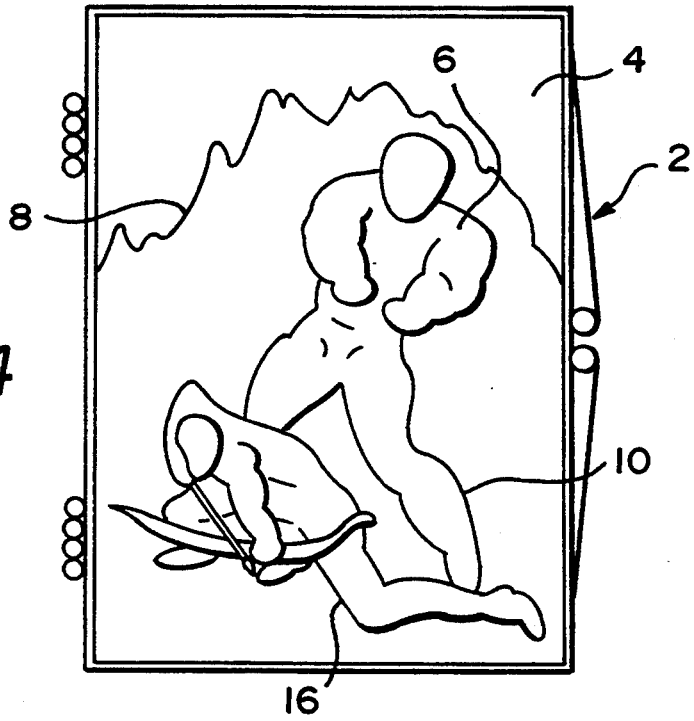
FIG. 4

3-D ILLUSTRATION

BACKGROUND OF THE INVENTION

In one aspect, this invention relates to the presentation of images, for example, in the form of photographs, cards or posters. In another aspect, this invention relates to a method for making such images.

Fixed two dimensional images are not well suited for depicting action, and artists, photographers and printers have long tried to capture this element in their works in order to stir the excitement of the viewer. A technique for converting a fixed two dimensional image into an image with enhanced action effect would be very desirable.

Fixed two dimensional images are further deficient in showing depth of view. Various techniques have been used to show depth of view, with varying degrees of success. Images which depict depth of view are striking because they are so unusual. A technique for converting a fixed two dimensional image into an image with enhanced depth of view would be further desirable.

OBJECTS OF THE INVENTION

It is an object of this invention to provide an image having an illusion of action.

It is a further object of this invention to provide an image having depth of view.

It is another object of this invention to provide a technique for converting fixed two dimensional images into images having a greater appearance of action and depth of view.

SUMMARY OF THE INVENTION

In one embodiment of the invention, there is provided an article of manufacture comprising a base structure and a superstructure. A mounting means is positioned between the base structure and the superstructure for mounting the superstructure on the base structure. The superstructure has an outer periphery in the shape of the first two dimensional graphic designs. The superstructure has a partial covering relationship with the base structure. The superstructure has a distance in the range of about 0.001 to about 1 inch from the base structure.

This embodiment of the invention provides an article which has a layered or three-dimensional appearance. It is easily provided from any two dimensional image, such as a card, poster or photograph, for which copies can be obtained. For such two dimensional images, providing altered images having an enhanced appearance of action and depth of view is now possible.

In another embodiment of the invention, there is provided a method of forming a three dimensional design. The method is practiced by combining a first base structure with pieces from a second base structure. The first and second base structures each has a first two dimensional graphic design imprinted on a portion thereof against a background design. A superstructure having an outer periphery in the shape of the first two dimensional graphic design is formed by cutting out the design from a second base structure. The superstructure is positioned in covering relationship with the first two dimensional graphic design on the first base structure at a position spaced apart from the first base structure.

The method can be applied to convert a two dimensional image for which copies can be obtained into a three dimensional image having depth of view and the enhanced illusion of action. Preferably, the periphery of the superstructure is colored to blend with either the foreground or background image to further enhance both depth of view and the impression of action.

In yet another embodiment of the invention, there is provided a base structure having a superstructure mounted thereon. The base structure has a background design imprinted thereon. The superstructure has an outer periphery in the shape of a first two dimensional graphic design and is positioned in partial covering relationship with the base structure. The superstructure is positioned at a distance in the range of about 0.001 to about 1 inch from the base structure to enhance the appearance of action and depth of view. Suitable mounting means is positioned between the base structure and the superstructure for so positioning the superstructure.

This embodiment of the invention permits the combination of features from different artworks into unique visual combinations.

BRIEF DESCRIPTION OF THE DRAWINGS

FIG. 1 illustrates a first step of one embodiment of the invention, wherein rolls of adhesive strip material have been applied to an action card of the type known in the art.

FIGS. 2 and 3 are cutouts from action cards of the type shown in FIG. 1.

FIG. 4 illustrates a 3-D action card formed according to one embodiment of the invention mounted in a clear display case.

DETAILED DESCRIPTION OF THE PREFERRED EMBODIMENTS

In one embodiment of the invention a three dimensional artwork 2 is provided which comprises a base structure 4 having a superstructure 6 mounted thereon. The base structure 4 has a background design 8 imprinted thereon. The superstructure 6 has an outer periphery 10 in the shape of a first two dimensional graphic design 14 and is positioned in partial covering relationship with the base structure 4. The superstructure 6 is positioned at a distance in the range of about 0.001 to about 1 inch from the base structure to enhance the appearance of action and depth of view. For small articles, such as cards, the spacing will usually be in the range of 0.01 to about 0.3 inches. Suitable mounting means 12 is positioned between the base structure 4 and the superstructure 6 for so positioning the superstructure 6.

In a preferred embodiment of the invention, the base structure has a first two dimensional graphic design 14 imprinted on a portion thereof which corresponds with the design on the superstructure 6. The superstructure 6 preferably has an outer periphery in the shape of the first two dimensional graphic design 14 positioned in covering relationship with the first two dimensional graphic design 14 on the base structure 4. In a further preferred embodiment of the invention, the superstructure 6 is provided by cutting out the design from a second base structure (not shown). In one embodiment of the invention, the second base structure is identical to the first base structure. In another embodiment, the second base structure is different from the first base structure. In this embodiment, the first base structure is preferably primarily a background design. Action figures from a second base structure can be cut out and mounted on the background design to create novel impression.

Generally speaking, both the base structure 4 and the superstructure 6 will be formed from paper stock. Where the three dimensional artwork is to be formed from action cards, the structures will of course be formed from card stock.

A wide variety of adhesive materials can be used for the mounting means 12. The material selected should have sufficient tack to secure the base structure to the superstructure. In the illustrated embodiment, the adhesive material is formed from rolls of tape. The tape is rolled into a cylindrical item. The spacing distance can be varied as desired by controlling the diameter of the cylinder. Where the superstructure is to be parallel to the base structure, the rolls will be of the same diameter. In the embodiment of the invention shown in FIG. 1, the superstructure 6 leans outwardly from the base of the superstructure and lies in a plane with is inclined with respect to the plane of the base structure. This is accomplished by utilizing a large diameter roll 160 adjacent an upper end of the figure and a small diameter roll 18 adjacent the lower end of the figure. It is expected that glue drops would also provide good results when employed as the adhesive material. The desired thickness could be built up by repeated applications of the droplets. Double-backed tape of varying thickness could also be used with good results. In any event, the adhesive material should be positioned in a location between the base structure and the superstructure at a position which is spaced apart from the periphery 10 of the superstructure so as not to be visible from the front.

The superstructure 6 is preferably formed by cutting out the desired figure from card stock. The cutting process leaves an unsightly unfinished white edge on the superstructure. It is desirable to color the edge to provide the product with a finished appearance. Water color pencils can be used with good results. The color selected can be any desired color. However, it is preferred that the color be selected to blend with either the coloration of the background design or the coloration of the two dimensional graphic design on the superstructure. Where the background design 8 is a light color, it is preferred that the coloration match the background color to give the appearance of backlighting. The effect can be further enhanced by cutting the superstructure figure with a beveled edge converging away from the base structure.

If desired, the article can be provided with a plurality of superstructures. In such case, the superstructures will each be generally differently shaped and will correspond to designs on the base structure. For example, a second superstructure FIG. 16 can be mounted on the base structure to provide greater viewer interest. The second superstructure 16 can be mounted at a different distance from the base structure than the first superstructure figure and can be positioned in a partial covering relationship with the first superstructure figure as illustrated. In such case, it may be necessary to consume three or more photographs, cards, and so forth in order to produce a finished article. This is because the first superstructure will generally have unfinished areas 20 having a portion of the second superstructure imprinted thereon to be covered by the second superstructure 16.

It is desirable that the finished product be mounted in a clear closure for protection and for display purposes. In the case of posters, a suitable closure could be formed by a frame having a glass pane for example. For trading cards, positioning the finished article in a clear plastic display case is highly desirable.

While certain preferred embodiments of the invention have been described herein, the invention is not to be construed as so limited, except to the extent such limitations are found in the claims.

What is claimed is:

1. An article comprising a base structure formed from card paper stock having a first two dimensional graphic design imprinted on a portion thereof against a background design;

a superstructure having an outer periphery in the shape of the first two dimensional graphic design, said superstructure positioned in covering relationship with the first two dimensional graphic design on the base structure, the outer periphery of the superstructure having pigmentation to blend with the coloration of the background design and with the coloration of the superstructure: and mounting means for so positioning the superstructure, wherein the outer periphery of said superstructure remains spaced apart from said base structure.

2. An article as in claim 1 wherein the means for positioning the superstructure is placed between the superstructure and the base structure such that the superstructure is spaced apart from the base structure at a distance in the range of from about 0.010 inches to about 1 inch.

3. An article comprising a base structure formed from card paper stock having a first two dimensional graphic design imprinted on a portion thereof against a background design;

a superstructure formed from card paper stock having an outer periphery in the shape of the first two dimensional graphic design, said superstructure positioned in covering relationship with the first two dimensional graphic design on the base structure;

an adhesive material positioning the superstructure on the base structure such that the superstructure is spaced apart from the base structure at a distance in the range from about 0.01 inches to about 0.3 inches and the outer periphery of said superstructure remains spaced apart from said base structure, said adhesive material being positioned in a location between the base structure and the superstructure at a position spaced apart from the periphery of the superstructure; and a clear plastic case containing the base structure and the superstructure.

4. An article as in claim 3 wherein the superstructure is positioned in a plane which is generally parallel to the plane of the base structure.

5. An article as in claim 3 wherein the superstructure is positioned in a plane which is generally inclined with respect to the plane of the base structure.

6. An article as in claim 3 wherein the outer periphery of the superstructure contains pigmentation to blend with the coloration of the background design and with the coloration of the superstructure.

7. An article as in claim 3 wherein the base structure has a plurality of different two dimensional designs imprinted thereon, said article further comprising a plurality of differently shaped superstructures corresponding to said designs mounted on said base structure at varying distances from said base structure.

8. An article as in claim 7 wherein certain superstructures are positioned in covering relationship with respect to other superstructures.

9. An article as in claim 8 wherein the base structure comprises a trading card.

10. An article as in claim 9 wherein each differently shaped superstructure has an outer periphery, wherein the outer periphery of each differently shaped superstructure contains pigmentation to blend with the coloration of the background design and with the coloration of the differently shaped superstructure.

* * * * *